United States Patent [19]

Hsu

[11] Patent Number: 4,728,937

[45] Date of Patent: Mar. 1, 1988

[54] SECURITY MEANS FOR SUITCASE

[76] Inventor: Chi-Hsueh Hsu, 4F, No. 144, Chu Lin Rd., Yung Ho, Taipei, Taiwan

[21] Appl. No.: 18,696

[22] Filed: Feb. 25, 1987

[51] Int. Cl.[4] ..... G08B 13/14

[52] U.S. Cl. ..... 340/571; 340/689

[58] Field of Search ..... 340/571, 689

[56] References Cited

U.S. PATENT DOCUMENTS

| | | | |
|---|---|---|---|
| 4,155,079 | 5/1979 | Chiu et al. | 340/571 |
| 4,204,202 | 5/1980 | Pai | 340/689 X |
| 4,272,763 | 6/1981 | Chang et al. | 340/571 |
| 4,462,023 | 7/1984 | Nielsen et al. | 340/689 X |

*Primary Examiner*—Glen R. Swann, III
*Assistant Examiner*—Thomas J. Mullen, Jr.
*Attorney, Agent, or Firm*—Morton J. Rosenberg

[57] ABSTRACT

A security means for suitcase comprises a suitcase body, a handle provided on the front wall of the suitcase body, a combination lock under the handle, two levels respectively provided on one side wall and back wall of the suitcase body, four push button switches provided on the back wall of the suitcase body, a warning system connected to the push button switches, a delay high potential electric shock system connected to the warning system and a battery connected to the push button switches.

2 Claims, 11 Drawing Figures

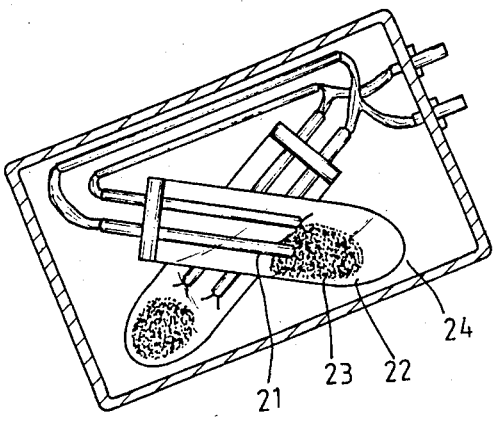
FIG. 2 - A
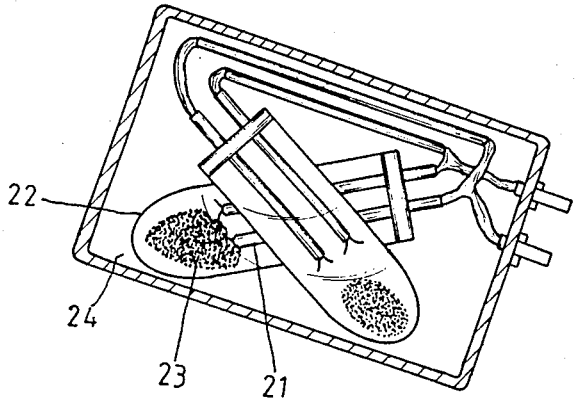
FIG. 2 - B

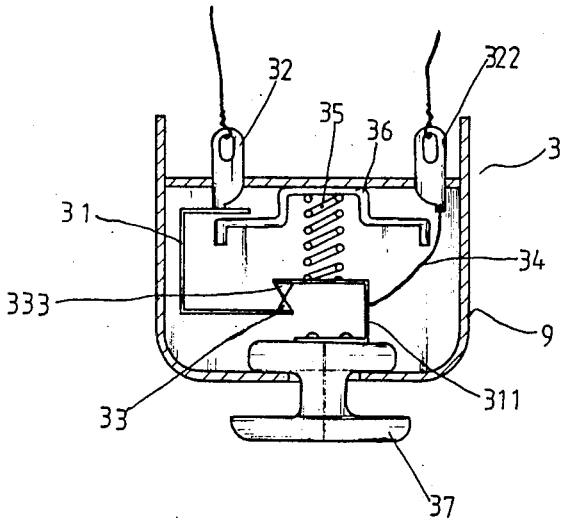
FIG. 3 - A

SECURITY MEANS FOR SUITCASE

BACKGROUND OF THE PREFERRED EMBODIMENTS OF THIS INVENTION

This invention relates to a security means for suitcase, particularly to one which is provided with a warning system and a delay high potential electric shock system.

Conventionally, the suitcase is not provided with an effective security means to prevent the suitcase from being stolen or robbed. To obviate the defects of the conventional art, one object of this invention is to provide a security means for suitcase which is provided with a warning system to warn against thieves or robbers.

Other object of this invention is to provide a security means for suitcase which is provided with a delay high potential electric shock system to render thieves or robbers under electric shock.

Other objects and merits of this invention will become apparent from reading the following detailed description of the preferred embodiments.

BRIEF DESCRIPTION OF THE DRAWINGS

FIG. 2A shows a state of FIG. 2 in a logitudinal sectional view;

FIG. 2B shows another state of FIG. 2 in a longitudinal sectional view;

FIG. 3A is a longitudinal sectional view of a push button switch of this invention in an on position;

DETAILED DESCRIPTION OF THE PREFERRED EMBODIMENTS OF THIS INVENTION

This invention relates to a security means for suitcase, particularly to one which is provided with a warning system and a delay high potential electric shock system.

Figure 1:
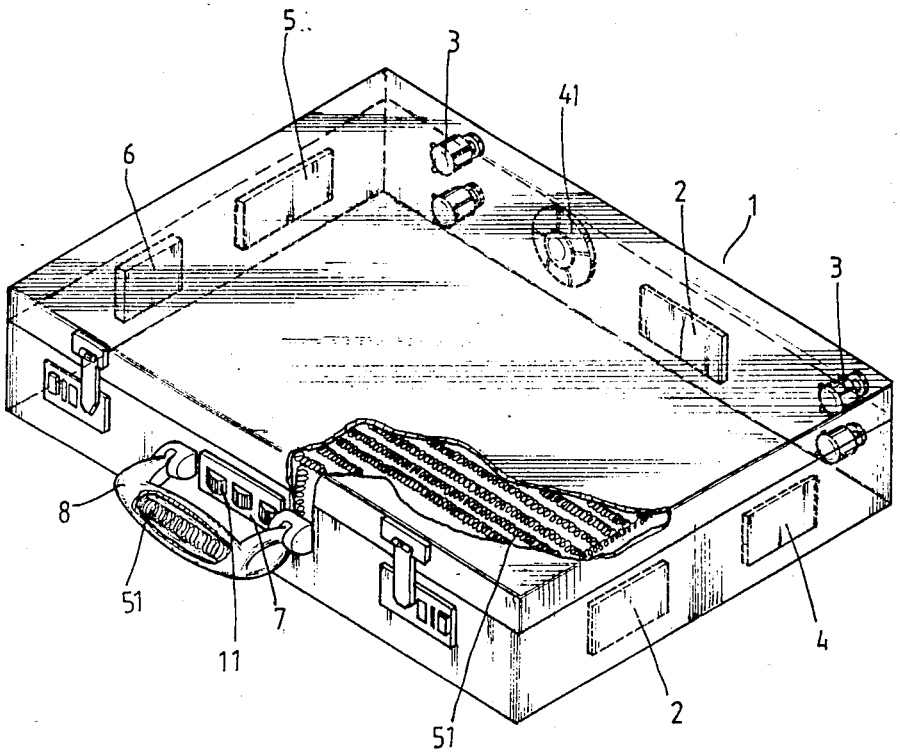
FIG. 1 is a perspective view of a preferred embodiment of this invention, partially taken away.
Figure 5:
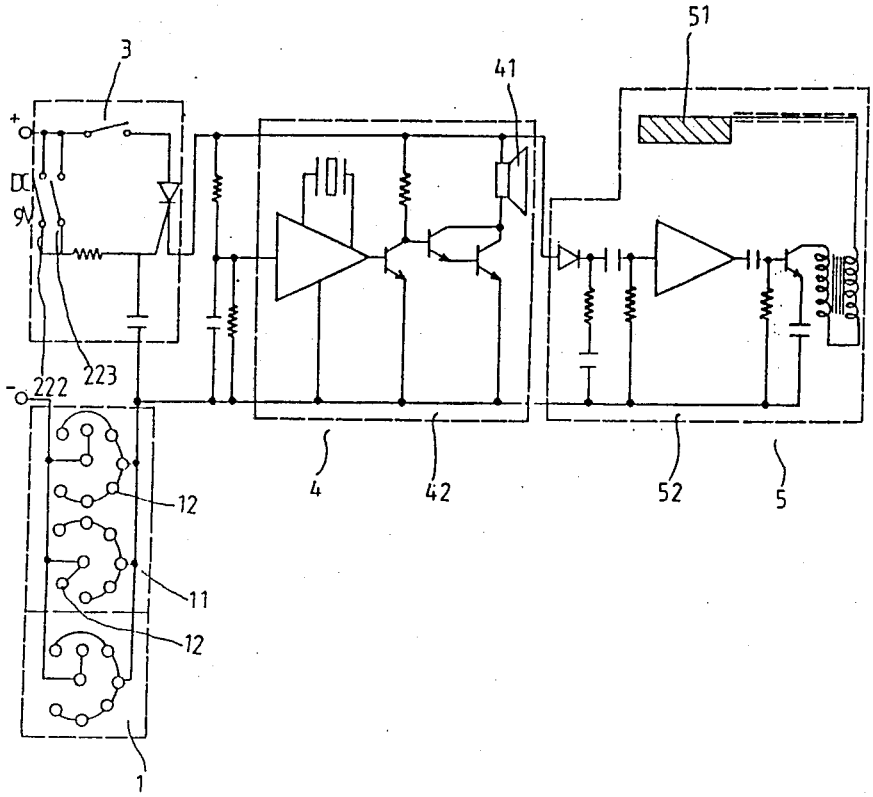
FIG. 5 is an electric circuit diagram of this invention.

As shown in FIGS. 1 and 5, a preferred embodiment of this invention comprises a suitcase body 1, a combination lock 7 provided on the front wall of the suitcase body 1 under a handle 8, two levels 2 respectively provided on one side wall and back wall of the suitcase body 1, four push button switches 3 provided on the back wall of the suitcase body 1, a warning system 4 connected to the push button switches 3, a delay high potential electric shock system 5 connected to the warning system 4 and a battery 6 connected to the push button switches 3.

Figure 4:
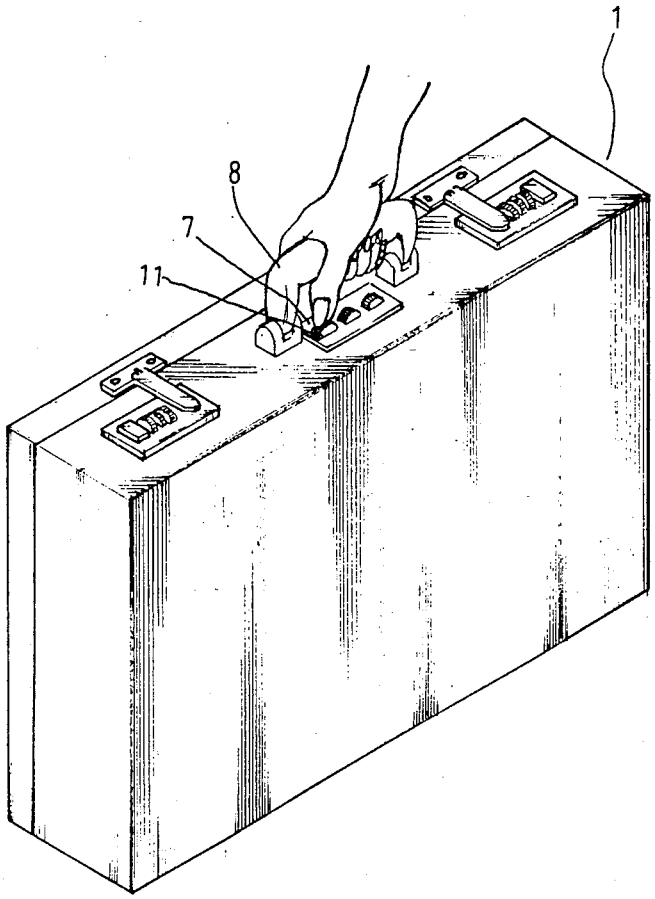
FIG. 4 is a perspective view of a preferred embodiment of this invention, particularly showing a combination lock thereof.

As shown in FIGS. 1 and 4, the combination lock 7 comprises a series of rotary rings 11 which are perpendicular to the thumb for the convenience of operation.

Figure 2:
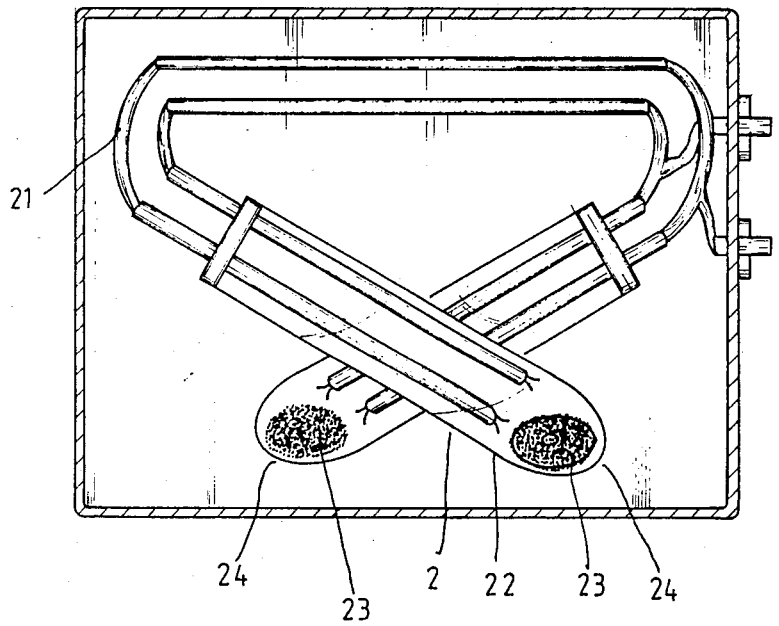
FIG. 2 is a longitudinal sectional view of a level of this invention.

Either of the two leves 2 as shown in FIG. 2 comprises a pair of sensors 24. And either of the sensors 24 comprises a conducting wire 21, a glass tube 22 for the conducting wire 21 to extend therein, and a liquid metal ball 23 contained in the bottom of the glass tube 22, the liquid metal ball 23 being separated from the lower end of the conducting wire 21 in a normal position.

One of the levels 2 is provided on the axis direction of the suitcase body 1 and given a reference number 222, while the other is provided on the y axis direction of the suitcase body 1 and given a reference 223. As shown in FIG. 2A, when the levels 2 stay in a horizontal position, the liquid metal ball 23 is in the lowest position of the glass tube 22, in other words, disconnected with the conducting wire 21, as a result of which the electric circuit is in an off position. However, when the levels 2 incline leftwise, the liquid metal ball 23 in one of each pair of sensors 24 will be in contact with the conducting wire 21 to turn the electric circuit in an on position. As shown in FIG. 2B, when the levels 2 incline rightwise, the electric circuit will also be in an on position.

Figure 3:
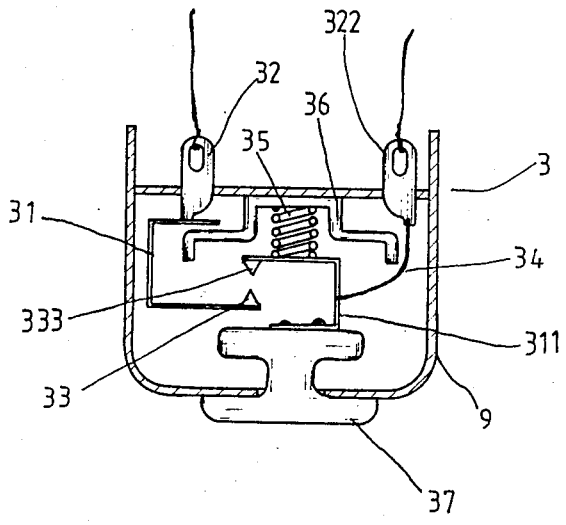
FIG. 3 is a longitudinal sectional view of a push button switch of this invention in an off position.

As shown in FIG. 3, there are four push button switches 3 respectively provided on four courners of the suitcase body 1. Further as shown in FIG. 3, each push button switch 3 comprises a switch housing 9, two connecting prongs 32 and 322 mounted on the upper wall of the switch housing 9, a conducting solid 37 with the upper portion inside of the switch housing 9 and the lower portion outside thereof, an upper conducting plate 31 being fixed onto the connecting prong 32 and provided with a conducting horn 33 at the lower end thereof, a lower conducting plate 311 being fixed onto the upper portion of the conducting solid 37 and provided with a conducting horn 333 at the upper end thereof, a conducting wire 34 connecting the lower conducting plate 311 and the connecting prong 322, a spring chamber 36 suspended onto the upper wall of the switch housing 9, and a spring 35 inserted with one end within the spring chamber 36 and biasing with the other end against the lower conducting plate 311. As shown in FIG. 3A, when the contacting solid 37 is not in contact with other things, the conducting horns 33 and 333 respectively of the conducting plates 31 and 311 contact with each other to turn the electric circuit in an on position. However, as shown in FIG. 3A, when the contacting solid 37 is in contact with other things and pressed, the contacting solid 37 will ascend to release the conducting horns 33 and 333 respectively of the conducting plates 31 and 311 from each other to turn the electric circuit off.

As shown in FIGS. 1 and 5, the warning system 4 comprises a signal generating circuit 42 and a buzzer 41 connected to one end of the signal generating circuit 42. When the levels 2 and the push button switches 3 are in an on position, the signal generating circuit 42 will be turned on to make the buzzer 41 buzz.

As shown in FIGS. 1 and 5, the delay high potential electric shock circuit 52 and a metal net 51 which are connected to the delay high potential electric shock circuit 52 and provided in the handle 8 and under the shell of the suitcase body 1. When the push button switches 3 is in an on position to turn the warning system 4 to produce a buzzing sound, the delay high potential electric shock circuit 52 will generate an electric power of high voltage from 13,000 v to 15,000 v and low electric current over the metal net 51 to render thieves or robbers under electric shock. For the delay high potential electric shock circuit 52 will delay for about five minutes to generate an electric power of high voltage, the suitcase owner may take advantage of the time lag to prevent himself from electric shock.

Figure 6:
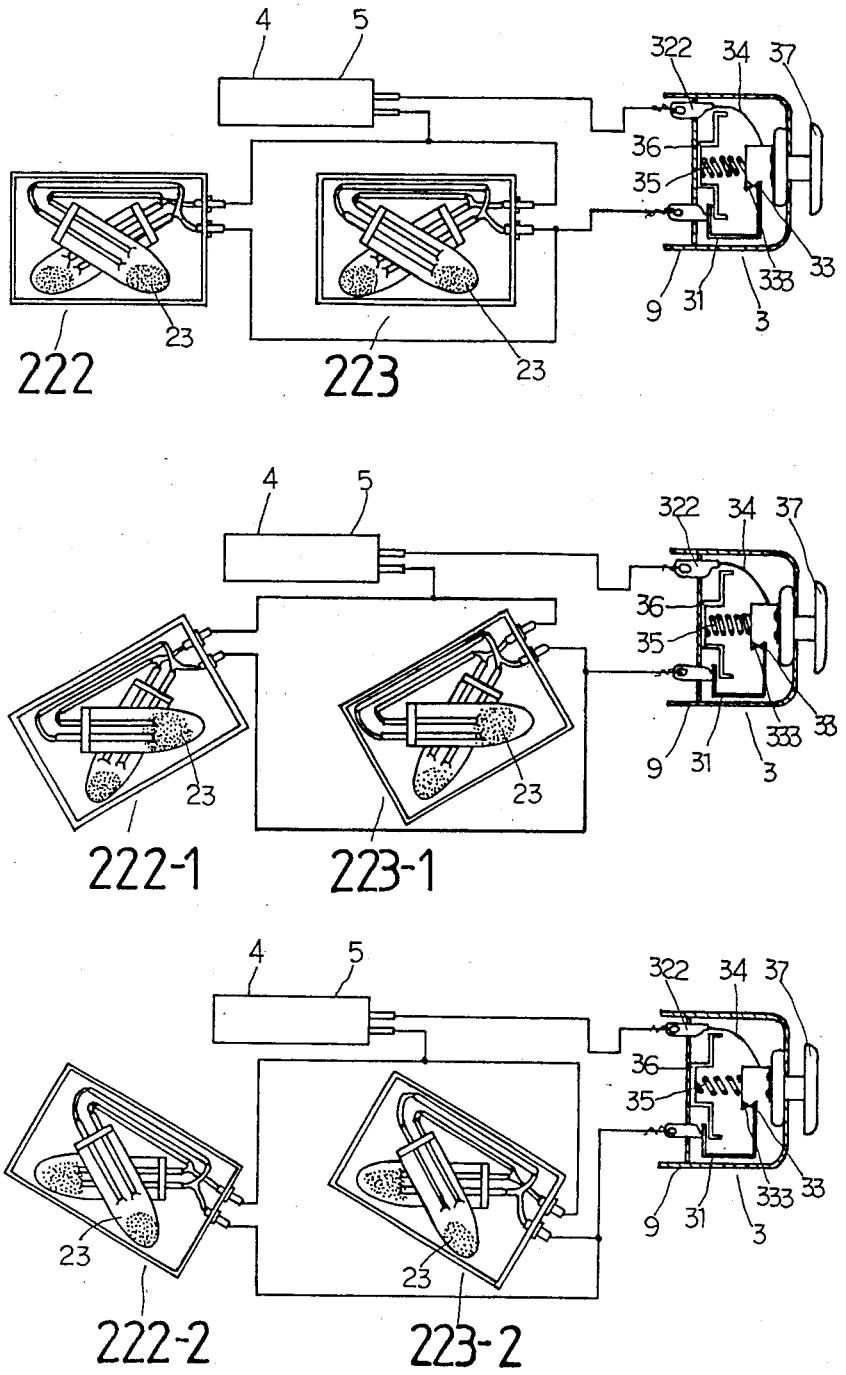
FIG. 6 shows the relative states between a level and a push button switch in a longitudinal view when a suitcase body of this invention lays flat.

As shown in FIG. 6, when the suitcase body 1 lays flat, the x axis sensor 222 and y axis sensor are in an off position. For the x axis sensor 222, y axis sensor 223 and the push button switches 3 combine into an electric circuit, the electric circuit will be in an off position though the conducting plates 31 and 311 contact with each other to turn the push button switches 3 in an on position and the x axis sensor 222 and y axis sensor 223 in an off position.

As shown in 222-1 and 223-1 of FIG. 6, when the suitcase body 1 is moved to incline leftwise, the liquid metal ball 23 will contact with the conducting wire 21 to turn the levels 2 in an on position. Thus, when the suitcase body 1 is moved, the x axis sensor 222 and y axis sensor 223 will be in an on position and combine with the push button switches 3 into an electric circuit as a result of which the warning system 4 and delay high potential electric shock system 5 will be generated to buzz and render thieves or robbers under electric shock. 222-2 and 223-2 of FIG. 6 shows a position where the x axis sensor 222 and y axis sensor 223 are in when the suitcase body 1 inclines rightwise.

Figure 7:
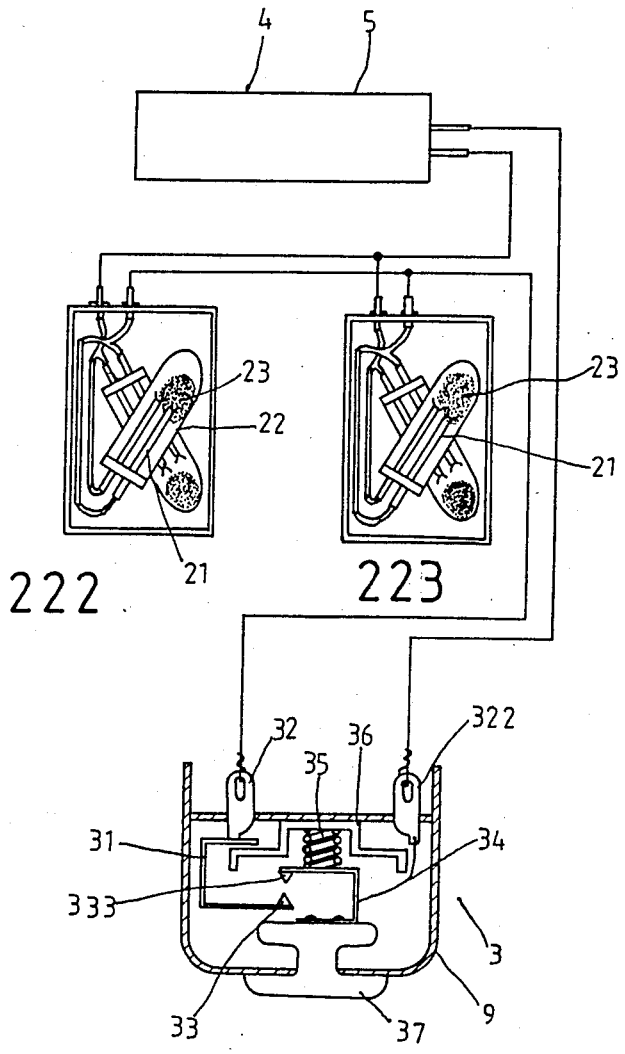
FIG. 7 shows the relative states between a level and a push button switch in a longitudinal view when a suitcase body of this invention stands up.
Figure 8:
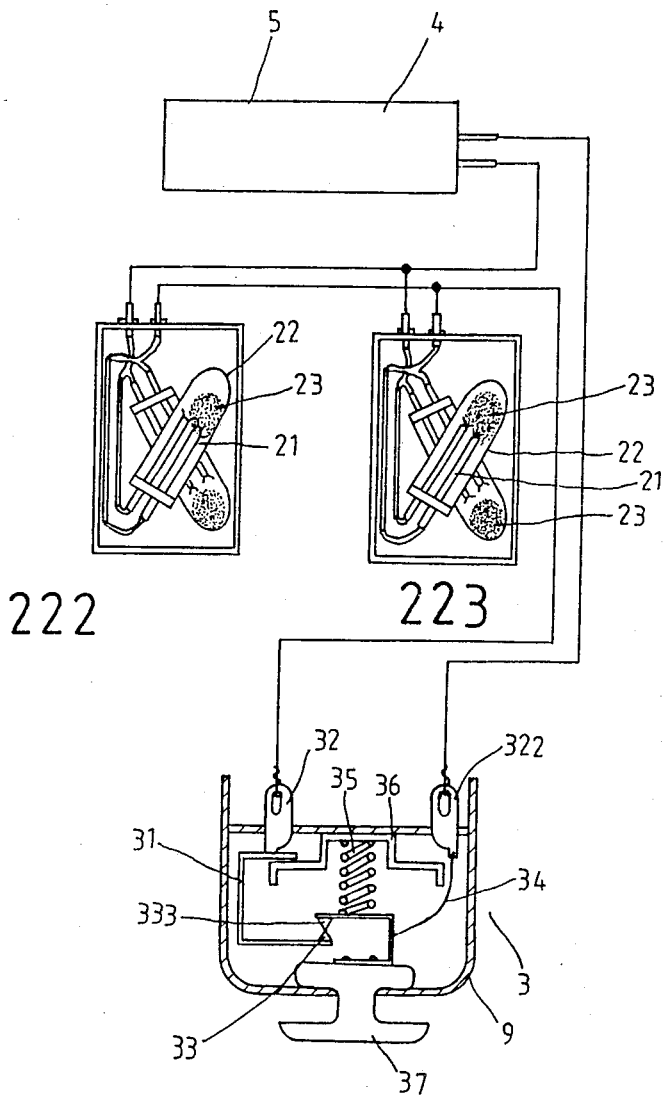
FIG. 8 shows the relative states between a level and a push button switch in a longitudinal view when a suitcase body of this invention is moved.

As shown in FIG. 7, when the suitcase body 1 stands up, the x axis sensor 222 and y axis sensor 223 are not in a horizontal position. For the liquid metal ball 23 is in contact with the conducting wire 21, the x axis sensor 222 and y axis sensor 223 are in an on position. Further for the x axis sensor 222, the y axis sensor 223 and the push button switches 3 combine into an electric circuit, the off position where the push button switches 3 are in makes the electric circuit also in an off position. When the suitcase body 1 which stands up is moved, the conducting plates 31 and 311 will contact with each other to turn the push button switches 3 to an on position. In this case, as shown in FIG. 8, for the x axis sensor 222, the y axis sensor 223 and push button switches 3 combine into a circuit, the circuit will be in an on position where the warning system 4 and delay high potential electric shock system 5 will be generated to buzz and render thieves or robbers under electric shock.

There are many contacting points 12 in the combination lock 7. Among the contacting points 12, one is an off point, while the others are on points. The combination lock 7 must be rotated to an off point to prevent the suitcase owner from being rendered under electric shock when he carries it. When the combination lock 7 is rotated to an off point, the whole circuit is in an off position though the x axis sensor 222, the y axis sensor 223 and push button switches 3 are in an on position. If someone comes to steal or rob the suitcase body 1 from the suitcase owner, the latter may rotate the rotary rings 11 of the combination lock 7 to turn the x axis sensor 222, the y axis sensor 223 and push button switches 3 to an on position where the warning system 4 and delay high potential electric shock circuit 52 will be generated to buzz and render thieves under electric shock.

It is to be noted that the above description aims to explain however not to limit the concept of this invention.

What I claim:

1. A security means for suitcase comprising a suitcase body, a handle provided on the front wall of said suitcase body, a combination lock under said handle, two levels respectively provided on one side wall and back wall of said suitcase body, four push button switches provided on one wall of said suitcase body opposite to the wall where said combination lock is provided, a warning system connected to said push button switches, a delay high potential electric shock system connected to said warning system, and a battery connected to said push button switches, each of said push button switches including a switch housing having two connecting prongs mounted on an upper wall of said switch housing, a contacting solid member partially located internal said switch housing and partially external thereof, an upper conducting plate fixedly secured to one of said connecting prongs and having a conducting horn located at a lower end thereof, a lower conducting plate fixedly secured to an upper portion of said contacting solid member and having a conducting horn at an upper end thereof, a conducting wire connecting said lower conducting plate and one of said connecting prongs, a spring chamber suspended onto said upper wall of said switch housing, and a spring inserted on one end within said spring chamber, a second end of said spring being biased against said lower conducting plate, said conducting horns of said upper and lower plates being in contact each with respect to the other.

2. A security means for suitcase as claimed in claim 1 wherein each of said levels comprises a pair of sensors, each sensor comprising a conducting wire, a glass tube for said conducting wire to extend therein, and a liquid metal ball contained in the bottom of said glass tube, said liquid metal ball being separated from the lower end of said conducting wire in normal position.

* * * * *